United States Patent [19]

Griffin

[11] 4,381,619

[45] May 3, 1983

[54] BUILDING BLOCK

[76] Inventor: David J. Griffin, 530 Main St., Cold Spring, Minn. 56320

[21] Appl. No.: 175,012

[22] Filed: Aug. 4, 1980

[51] Int. Cl.[3] ..... A63H 33/08

[52] U.S. Cl. ..... 46/25; 52/590; 52/609; 273/157 R

[58] Field of Search ..... 46/23, 24, 25, 26, 16; D25/92, 88; D21/107, 108; 52/590, 594, 609, 610, 611; 273/160, 157 R

[56] References Cited

U.S. PATENT DOCUMENTS

| | | | |
|---|---|---|---|
| D. 155,329 | 9/1949 | Bindman | 46/25 X |
| D. 169,482 | 5/1953 | Henke et al. | 273/157 R |
| 169,709 | 6/1877 | Kinsey | 46/26 |
| 430,502 | 6/1890 | Altekruse | 273/160 |
| 1,428,206 | 9/1922 | Benton | 273/157 R |
| 1,562,006 | 11/1925 | Sichterman | 46/25 |
| 1,894,605 | 1/1933 | Wright | 46/25 |
| 2,147,237 | 2/1939 | Bluthardt | 46/16 X |
| 2,278,327 | 3/1942 | Magnus et al. | 46/25 |
| 3,410,021 | 11/1968 | Patterson | 46/16 X |
| 3,449,857 | 6/1969 | De Christopher | 46/16 X |
| 3,819,188 | 6/1974 | Freedman | 46/24 |
| 3,838,535 | 10/1974 | Larws | 46/25 |

*Primary Examiner*—F. Barry Shay

*Attorney, Agent, or Firm*—Emrich, Lee, Brown & Hill

[57] ABSTRACT

A substantially rectangular-shaped building block, particularly well adapted for use in a set of identical toy building blocks, having a length, to width, to thickness ratio in the nature of 3 to 2 to 1, and having each of the four corner portions identical in cross-sectional size and shape to an indentation in the center portion of each of the four sides of the rectangle.

8 Claims, 15 Drawing Figures

BUILDING BLOCK

BACKGROUND OF THE INVENTION

This invention relates to building blocks, and, more particularly, to building blocks which are particularly well adapted for use as toy building blocks.

A primary object of the present invention is to afford a novel building block.

Another object is to afford a novel building block which is so constituted and arranged that, by using a plurality thereof, various shapes and configurations of assemblies of such building blocks may be connected together.

Building blocks which may be connected together have been heretofore known in the art, being shown, for example, in the following United States Letters Patent, namely, Ellis Pat. No. D-4058; Bindman Pat. No. D-155 329; Groves Pat. No. 1,271,160; Greenstreet Pat. No. 1,371,619; Sichterman Pat. No. 1,562,006; Bluthardt Pat. No. 2,147,237; Magnus Pat. No. 2,278,327Fischer Pat. No. 3,456,413; Jacob Pat. No. 3,570,169; Bullock, Jr. Pat. No. 3,626,632; Freedman Pat. No. 3,819,188; Larws Pat. No. 3,838,535; and Inman Pat. No. 4,189,252. It is an important object of the present invention to afford a novel building block, which constitutes improvements over building blocks of the aforementioned type heretofore known in the art.

Building blocks of the type which may be connected together, which have been heretofore known in the art, have had several inherent disadvantages, such as, for example, being expensive to manufacture; being difficult to construct; being difficult to assemble; not affording a reliable assembled structure; or being impractical in construction and operation, and the like. It is another important object of the present invention to overcome such disadvantages.

Another object of the present invention is to afford a novel building block, which is so constructed that a plurality of such blocks may be connected to each other in a myriad of different shapes and assemblies.

Another object of the present invention is to afford a novel building block of the aforementioned type, the construction of which is such that two individual blocks may be connected to each other in a novel and expeditious manner, and, if desired, one individual block may be connected to a plurality of other blocks in a novel and expeditious manner.

A further object of the present invention is to afford a novel building block of the aforementioned type wherein, if desired, a single one of the blocks may be connected to two other of the blocks in such a manner as to afford an effective retention of the two blocks against being pulled away from each other.

Another object of the present invention is to afford a novel building block of the aforementioned type which is practical and efficient in operation, and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
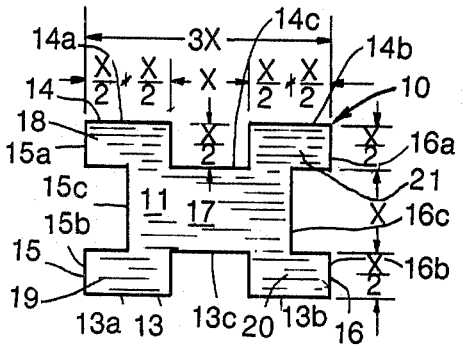
FIG. 1 is a a front elevational view of a building block embodying the principles of the present invention.
Figure 2:
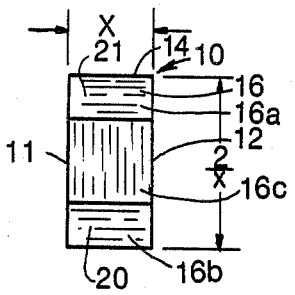
FIG. 2 is an end elevational view of the building block shown in FIG. 1.
Figure 3:
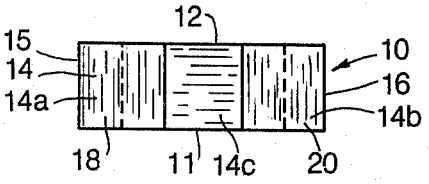
FIG. 3 is a top plan view of the building block shown in FIG. 1.

A building block 10, embodying the principles of the present invention, is shown in FIGS. 1–3 of the drawings to illustrate the presently preferred embodiment of the present invention; and, in FIGS. 4–15, various assemblies of a plurality of identical building blocks 10 are illustrated to illustrate various typical structures that may be built with a plurality of the building blocks 10.

The building block 10, FIGS. 1–3, is substantially rectangualr in shape, having a front face 11 and a rear face 12 disposed on opposite sides thereof in spaced, substantially parallel relation to each other. The building block 10 also embodies two sides 13 and 14 extending longitudinally of the block 10 in substantially parallel relation to each other, on opposite sides of the faces 11 and 12. In addition, the building block 10 embodies two ends 15 and 16 extending transversely to the length of the building block 10 in parallel spaced relation to each other.

Each of the sides 13 and 14 embodies two end portions **13*a* and 13*b*, and 14*a* and 14*b*, respectively, disposed in uniplanar relation to each other, and an intermediate portion, in the form of a recess or indentation 13*c* and 14*c* disposed between the end portions 13*a* and 13*b*, and the end portions 14*a* and 14*b*, respectively, FIG. 1. Similarly, each of the ends 15 and 16 embodies oppositely disposed end portions 15*a* and 15*b*, and 16*a* and 16*b*, respectively, disposed in uniplanar relation to each other, and an intermediate portion, in the form of a recessor indentation 15*c* and 16*c* disposed between the end portions 15*a* and 15*b*, and 16*a* and 16*b***, respectively.

In the preferred form of the building block 10, shown in FIGS. 1–3, the length (between the ends 15 and 16), the width (between the sides 13 and 14) and the thickness (between the faces 11–12) are in the ratio of 3-2-1. Thus, if the thickness of the block 19 is "x" the width thereof is 2x and the length thereof is 3x.

Also, in the preferred form of the building block 10 shown in FIGS. 1–3, the length of each of the end portions **13*a*, 13*b*, 14*a* and 14*b*, and of the indentations 13*c*, 14*c*, 15*c* and 16*c* is equal to the aforementioned x, with the depth of the indentations 13*c*, 14*c*,15*c* and 16*c* being x/2. Also, the length of the end portions 15*a*15*b*, 16*a* and 16*b* is x/2. The width of each of the aforementioned end portions and indentations of course, is equal to the thickness of the block 10**, namely, a width of "x".

With such construction, the block 10 embodies a rectangular shaped, centrally disposed, main body portion 17 and four identical corner portions 18, 19, 20 and 21 projecting outwardly from respective corners of the main body portion 17, FIG. 1, with each of the corner portions 18–21 being complementary in cross-sectional size and shape to each of the indentations 13c–16c.

Figure 4:
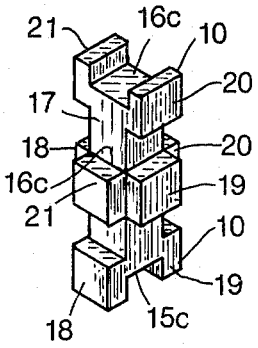
FIGS. 4–5 are perspective views, each embodying a plurality of building blocks of the type shown in FIGS. 1–3, showing various forms of typical structures and/or arrangements of building blocks that may be formed withbuilding blocks having the construction of the building block shown in FIGS. 1–3.
Figure 5:
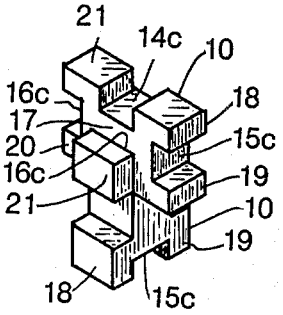
Figure 6:
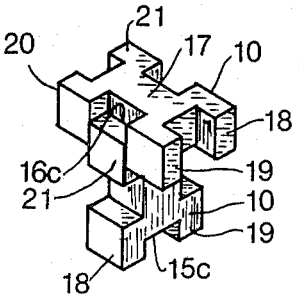

With this construction, pluralities of identical building blocks 10 may be connected together in a multitude of various forms and of assemblies, typical, illustrative ones of which are shown in FIGS. 4–15. Thus, for example, as shown in FIGS. 4–6, two blocks 10 may be assembled in vertically disposed relation to each other, with one block 10, such as the lowermost block 10 shown in FIGS. 4–6, disposed in longitudinally extending, upright position, and with the other block 10 disposed in longitudinal alignment therewith, with one end of the main body portion 17 of the second block disposed in the upper indentation 15c or 16c of the first block, the upper indentation being 16c as shown in FIG. 4; or with one side of the main body portion 17 of the other block disposed in the upper indentation 15c or 16c in the first mentioned block in such position as to dispose the corners 18 and 19, and the corners 20 and 21, respectively, of the second block 10 in vertically spaced relation to each other, as shown in FIG. 5; or with the side of the main body portion 17 of the second block disposed in the upper indentation 15c or 16c of the first block in such position as to dispose the corner portions 18 and 19, and the corner portions 20 and 21, respectively, of the second block 10 in horizontally spaced relation to each other, as shown in FIG. 6. These assemblies may be repeated vertically as many times as desired, as will be appreciated by those skilled in the art. Also, as will be appreciated by those skilled in the art, these assemblies may be extended horizontally rather than vertically, if desired.

Figure 7:
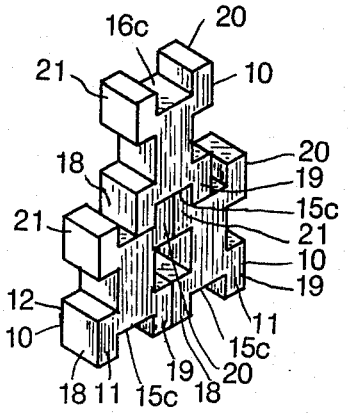
Figure 8:
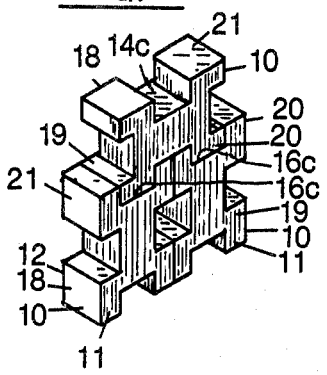
Figure 9:
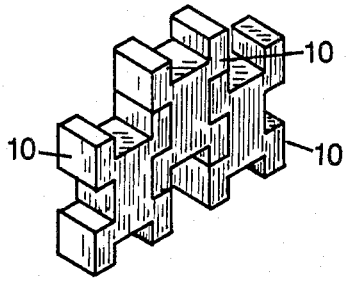
Figure 10:
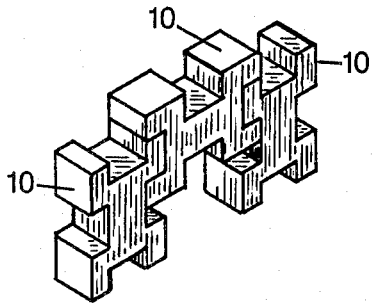
Figure 11:
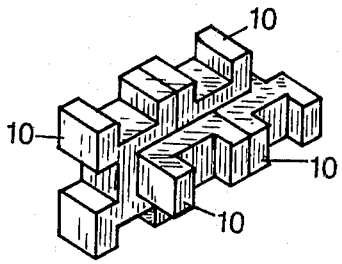
Figure 12:
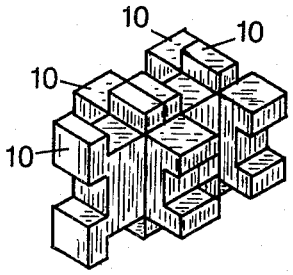
Figure 13:
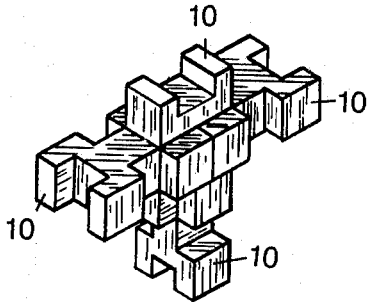
Figure 14:
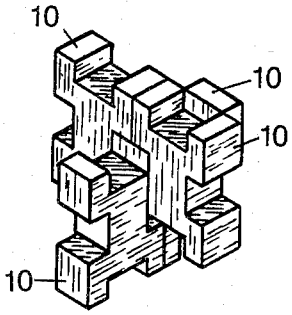

Also, inter-locking arrangements of the blocks 10 may be constructed such as, for example, as shown in FIGS. 7 and 8. In FIG. 7, two lower blocks 10 are disposed in transversely aligned relation to each other, with the respective faces 11 and 12 disposed in uniplanar relation to each other, and with an upper block 10 disposed in position wherein the adjacent corner portions 20 and 21 of the respective lower blocks 10 are disposed in the indentation 15c of the upper block 10. Such interlocking of the upper block 10 with the two lower blocks 10 is effective to hold the lower blocks 10 against movement laterally away from each other.

In FIG. 8, a somewhat similar inter-locking arrangement of three blocks 10 is shown, in this instance, the upper block 10 being disposed in transversely extending relation, with the corner portions 19 and 20 disposed in the indentations 16c of the respective lower blocks 10 in such position as to be effective to prevent the lower blocks 10 from being pulled transversely away from each other.

As will be appreciated by those skilled in the art, such inter-locking construction, as shown in FIGS. 7 and 8 may be repeated vertically as many times as is desired, new pairs of lower blocks 10 being disposed on top of the upper blocks 10 with the adjacent corner portions 18 and 19 of the lower blocks 10 being disposed in the upper recesses 16c and 14c of the upper blocks 10 shown in FIGS. 7 and 8, respectively. Also, as will be appreciated by those skilled in the art, such assemblies may, if desired, be extended horizontally rather than vertically.

Figure 15:
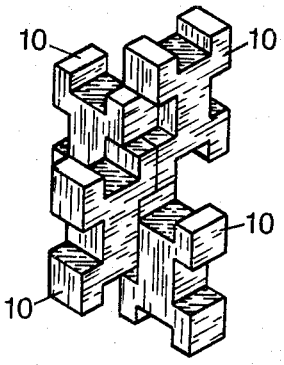

Also, various other assemblies may be constructed of a plurality of identical building blocks 10, such as, for example, those shown in FIGS. 9–15 of the drawings, including stepped assemblies, such as that shown in FIG. 15.

Thus, it will be seen that a myriad of various structural shapes and constructions may be readily assembled by using a plurality of identical building blocks 10 in different manners, the blocks 10 being so constructed that individual main body portions 17, (FIGS. 4–6) or individual corner portions 18,19, 20 and 21 may be disposed in individual indentations 13c–16c (FIGS. 7 and 8), or a plurality of corner portions 18–21 may be disposed in individual indentations 13c–16c(FIGS. 7 and 8) to afford various assemblies, such as, for example, those shown in FIGS. 4–15.

From the foregoing, it will be seen that the present invention affords a novel building block.

In addition, it will be seen that the present invention affords a novel building block, which is particularly well adapted for use in a set of toy building blocks.

Also, it will be seen that the present invention affords a novel building block the use of which by a child is both entertaining and instructive.

Further, it will be seen that the present invention affords a novel building block which is practical and efficient in operation, and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I clain:

1. A set of interfitting toy building blocks, with each block having rectangular dimensions of 3x by 2x by x and comprising, a substantially rectangular-shaped main body portion having dimensions of 2x by x by x four spaced corner portions, with each of said corner portions projecting outwardly from a respective corner of said main body portion, four indentations, with each of said indentations disposed between a respective pair of said corner portions, and wherein each of said corner portions is complementary in size and shape to each of said indentations.

2. A set of toy building blocks as defined in claim 1, and in which a. each of said indentations has a rectangular dimensions of x by x by x/2.

3. A substantially rectangular-shaped building block comprising a. a substantially flat front face, b. a substantially flat rear face, spaced from said front face in substantially parallel relation thereto, c. two oppositely disposed sides extending the length of said block between said faces, and d. two oppositely disposed ends extending the width of said block between said faces, e. each of said sides having (1) two oppositely disposed, substantially uniplanar end portions, and (2) an intermediate indentation separating said end portions, f. each of said end portions and each of said intermediate indentations having a length, parallel to said faces, equal to the width thereof, perpendicular to said faces, g. each of said intermediate indentations having a depth, perpendicular to the plane of the adjacent pair of said end portions, equal to one-half of said width thereof, h. each of said ends having (1) two oppositely disposed, substantially uniplanar end portions, and (2) an intermediate indentation separating said last mentioned end portions, i. each of said last mentioned end portions having (1) a length, parallel to said faces, equal to one-half said lengths and widths of said first mentioned end portions and said first mentioned indentations, and (2) a width, perpendicular to said faces, equal to said lengths and widths of said first mentioned end portions and said first mentioned indentations, and j. each of said second mentioned indentations having a length, parallel to said faces, a width, perpendicular to said faces, and a depth, perpendicular to the plane of the adjacent pair of said second mentioned end portions, equal to said length, width and depth, respectively, of each of said first mentioned indentations, k. said intermediate indentations and said second mentioned indentations being adapted to matingly receive portions of other blocks which have dimensions matching those of the indentations.

4. A building block as defined in claim 1, and in which said block comprises a. a substantially centrally disposed, rectangular-shaped main body portion, and b. four corner portions, each of which projects outwardly from a respective corner of said main body portion.

5. A building block as defined in claim 4, and in which a. each pair of adjacent ones of said corner portions are separated from each other by a respective one of said indentations.

6. A building block as defined in claim 5, and in which a. each of said corner portions is complementary in cross-sectional size and shape to each of said indentations.

7. A building block as defined in claim 6, and in which a. the length and width of each of said indentations is each equal to twice the depth of said indentation.

8. A building block as defined in claim 7, and in which a. said main body portion has (1) a length twice the length of each of said indentations, (2) a width equal to the length of each of said indentations, and (3) a thickness equal to the length of each of said indentations.

* * * * *